US010876487B2

(12) United States Patent
Park et al.

(10) Patent No.: US 10,876,487 B2
(45) Date of Patent: Dec. 29, 2020

(54) METHOD FOR INJECTOR INJECTION ERROR DIAGNOSIS USING DIAGNOSTIC INRUSH CONDITION AND SYSTEM THEREOF

(71) Applicants: Hyundai Motor Company, Seoul (KR); Kia Motors Corporation, Seoul (KR)

(72) Inventors: Su-Young Park, Uiwang-Si (KR); Tae-Young Kim, Gunpo-Si (KR); Doo-Hwan Kim, Hwaseong-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/570,503

(22) Filed: Sep. 13, 2019

(65) Prior Publication Data

US 2020/0109681 A1 Apr. 9, 2020

(30) Foreign Application Priority Data

Oct. 8, 2018 (KR) ..... 10-2018-0119709

(51) Int. Cl.
*F02D 41/22* (2006.01)
*F02D 41/38* (2006.01)

(52) U.S. Cl.
CPC ..... *F02D 41/221* (2013.01); *F02D 41/38* (2013.01); *F02D 2041/224* (2013.01)

(58) Field of Classification Search
CPC ... F02D 41/221; F02D 41/38; F02D 2041/224
USPC ..... 123/446
See application file for complete search history.

(56) References Cited

U.S. PATENT DOCUMENTS 5,113,651 A * 5/1992 Kotzan ..... F01N 3/222 60/274
2003/0131655 A1* 7/2003 Miyahara ..... F02M 25/0818 73/37
2005/0022588 A1* 2/2005 Hayakawa ..... F02M 25/0809 73/114.41
2005/0139197 A1* 6/2005 Ohhashi ..... F02D 41/266 123/520
2018/0171921 A1* 6/2018 Park ..... F02D 41/22

FOREIGN PATENT DOCUMENTS

KR 10-2009-0063897 A 6/2009

* cited by examiner

*Primary Examiner* — Mahmoud Gimie
(74) *Attorney, Agent, or Firm* — Morgan, Lewis & Bockius LLP

(57) ABSTRACT

A system and a method for injector injection error diagnosis include a controller which performs the method having a diagnostic inrush condition control by satisfying air tank pressure of an air tank as an injector injection error diagnosis entry condition while presence or absence of the application of an air compressor is divided between injector injection error diagnosis entry and injector injection error diagnosis execution according to detection of operations of an engine system and an air pressure brake system.

18 Claims, 7 Drawing Sheets

METHOD FOR INJECTOR INJECTION ERROR DIAGNOSIS USING DIAGNOSTIC INRUSH CONDITION AND SYSTEM THEREOF

CROSS-REFERENCE TO RELATED APPLICATION

The present application claims priority to Korean Patent Application No. 10-2018-0119709, filed on Oct. 8, 2018, the entire contents of which is incorporated herein for all purposes by this reference.

BACKGROUND OF THE INVENTION

Field of the Invention

The present invention relates to a control of injector injection error diagnosis and more particularly, to a system for injector injection error diagnosis which eliminates an effect of misdiagnosis due to an engine load by setting air tank pressure as a diagnostic inrush condition of the injector injection error diagnosis.

Description of Related Art

Generally, a commercial vehicle has a risk of misdiagnosis by applying a method for injector injection error diagnosis using an angular velocity variation error for each cylinder or an injection correction amount error for each cylinder in an engine system.

The reason for the present misdiagnosis of the injector injection error diagnosis is that the compensation of pressure of an air tank for a pneumatic brake system is performed by an air compressor and the engine load due to the operation of the air compressor affects the angular velocity and the correction amount for each cylinder.

Therefore, the commercial vehicle utilizes the diagnostic inrush condition that reflects the engine load depending on whether the air compressor operates or not to the injector injection error diagnosis to prevent misdiagnosis caused by disturbance of the angular velocity and the correction amount due to the engine load For example, the injector injection error diagnosis control using the diagnostic inrush condition of the commercial vehicle is a method of adding a pressure sensor to the air compressor and confirming a predetermined pressure detection value of the pressure sensor by an operation of the air compressor to stop the injector injection error diagnosis until the load to the engine disappears and then rush in the injector injection error diagnosis only when the load disappears. The reason is that at a predetermined level or less of the air tank pressure by use of the brake, the pressure of the air tank is filled with air pressure of the air compressor again by controlling a valve of an air pressing unit (APU), and in the filling process, the operation of the air compressor acting as the load during the engine driving is continued until the pressure of the air tank is raised above the predetermined level.

From this, the commercial vehicle utilizes the method for injector injection error diagnosis based on the angular velocity variation error of the cylinder or the injection correction amount error for each cylinder, and also avoids an engine load generation area according to the operation of the air compressor which causes disturbance of the angular velocity and the correction.

However, there are the following disadvantages due to characteristics of a commercial vehicle by applying an air compressor as the diagnostic inrush condition of the injector injection error diagnosis control.

The first disadvantage is in terms of cost, and this is because the pressure sensor is newly added to the air compressor to increase the cost. The second disadvantage is in terms of control, and this is because the diagnostic logic correspondence is required to cover all injector injection errors with respect to the specifications of the air compressor and the vacuum pump, which are divided according to a brake type even in one commercial vehicle. The third disadvantage is in terms of misdiagnosis, and this is because the limited setting of the diagnostic inrush condition by applying the air compressor has a possibility to generate misdiagnosis again during the misinput of the data (e.g., divided data of air compressor application/non-application).

The information included in this Background of the Invention section is only for enhancement of understanding of the general background of the invention and may not be taken as an acknowledgement or any form of suggestion that this information forms the related art already known to a person skilled in the art.

BRIEF SUMMARY

Various aspects of the present invention are directed to providing a method for injector injection error diagnosis using a diagnostic inrush condition and a system for injector injection error diagnosis in which an engine load generation area is avoided by air tank pressure according to an operation of the air compressor causing disturbance of angular velocity and correction amount for each cylinder to prevent misdiagnosis and particularly, a pressure sensor applied to the air tank is used to reduce the cost due to the non-application of the pressure sensor for the air compressor and eliminate an effect on the misdiagnosis of the misinput data by logic unification regardless of a brake type.

A method for injector injection error diagnosis of the present invention to achieve the objects may include a diagnostic inrush condition control of establishing an injector injection error diagnosis entry condition as air tank pressure of an air tank applied to an air pressure brake system according to presence or absence of an air compressor when injector injection error diagnosis entry of a controller for an injector performing fuel injection to an engine of an engine system is performed.

In an exemplary embodiment of the present invention, the diagnostic inrush condition control is performed by a diagnostic inrush condition dividing step of dividing air compressor application data and air compressor non-application data according to the presence or the absence of the air compressor, a step of generating an air compressor determination condition signal by any one of the air compressor application data and the air compressor non-application data, a step of generating an injector injection error diagnosis inrush condition signal by detecting the air compressor determination condition signal, engine operation information related to the engine system, and brake operation information related to the air pressure brake system, and a step of establishing an injector injection error diagnosis enable condition by a change of the air tank pressure.

In an exemplary embodiment of the present invention, in the air compressor application data, the air compressor determination condition signal is generated by confirming an air tank pressure diagnosis signal enable in a data misinput diagnosis enable state. When the air tank pressure diagnosis signal enable is not confirmed, the injector injection error inrush diagnosis is stopped, the stop of the injector injection error inrush diagnosis is indicated on a cluster as an error code, and communication error diagnosis for non-confirmation of the air tank pressure diagnosis signal enable before the stop of the injector injection error inrush diagnosis is performed.

In an exemplary embodiment of the present invention, in the air compressor non-application data, the air compressor determination condition signal is generated by confirming an air tank pressure diagnosis signal disable in the data misinput diagnosis enable state. When the air tank pressure diagnosis signal disable is not confirmed, the injector injection error inrush diagnosis is stopped, the stop of the injector injection error inrush diagnosis is indicated on the cluster as an error code, and data misinput diagnosis for non-confirmation of the air tank pressure diagnosis signal disable before the stop of the injector injection error inrush diagnosis is performed.

In an exemplary embodiment of the present invention, the air compressor determination condition signal is indicated on a cluster and transmitted to the controller. The injector injection error diagnosis inrush condition signal is output to a flag. The change of the air tank pressure is generated by an operation of the air compressor acting as a load of the engine and the change of the air tank pressure is a state in which the air tank returns to a predetermined pressure after a pressure reduction.

In an exemplary embodiment of the present invention, after the diagnostic inrush condition control, an injector injection error diagnosis execution control is performed and the injector injection error diagnosis execution control is to determine an angular velocity variation amount for each cylinder or an injection correction amount for each cylinder of the engine using the injector.

Furthermore, a system for injector injection error diagnosis of the present invention to achieve the objects may include a controller which performs a diagnostic inrush condition control by satisfying air tank pressure of an air tank as an injector injection error diagnosis entry condition while the presence or absence of the application of an air compressor is divided between injector injection error diagnosis entry and injector injection error diagnosis execution according to detection of operations of an engine system and an air pressure brake system.

In an exemplary embodiment of the present invention, the controller detects the air tank pressure of the air pressure brake system in association with a cluster that form a driver's seat, the air tank pressure is detected by an air tank pressure sensor disposed in the air tank, and communication between the controller and the cluster is performed by CAN.

In an exemplary embodiment of the present invention, the controller is configured by a data unit, a determination condition unit divided into an air compressor application processor, an air compressor non-application processor, air compressor data, and an output unit, and a diagnostic inrush condition unit, and an injector injection error diagnosis unit.

In an exemplary embodiment of the present invention, the data unit may include air compressor application data, air compressor non-application data, air tank pressure, and a CAN signal flag as input information.

In an exemplary embodiment of the present invention, the air compressor application processor generates an air compressor application output signal by setting a combination of an air tank pressure diagnosis signal enable, a CAN communication error diagnosis, and an injector injection error diagnosis inrush blocking error code as a satisfaction condition, the air compressor non-application processor generates an air compressor non-application output signal by setting a combination of an air tank pressure diagnosis signal enable, a data misinput fault diagnosis, and an injector injection error diagnosis inrush blocking error code as a satisfaction condition, the air compressor data generates an output signal for the air compressor application data or the air compressor non-application data, the output unit output the output signal for the air compressor application data or the air compressor non-application data as an air compressor determination condition signal according to the output signal of the air compressor data.

In an exemplary embodiment of the present invention, the diagnostic inrush condition unit outputs the air compressor determination condition signal as an injector injection error inrush condition signal by setting engine operation information related to the engine system and brake operation information related to the air pressure brake system as a satisfaction condition.

In an exemplary embodiment of the present invention, the injector injection error diagnosis unit generates an output signal for injector injection error diagnosis execution.

According to an exemplary embodiment of the present invention, the injector injection error diagnosis applied to the system for injector injection error diagnosis implements the following functions and effects by setting the air tank pressure as the diagnostic inrush condition.

First, to prevent the injector injection error misdiagnosis, a separate pressure sensor is not additionally mounted on the air compressor, but the mounted pressure sensor of the air tank (that is, the air cylinder) connected to the air compressor is used, reducing the cost of the addition of the new pressure sensor. Second, data may be unified by changing the diagnostic condition to diagnose the diagnostic inrush condition for preventing disturbance of the engine load only under the condition that the pressure of the air tank is stabilized above a certain level. Third, two types of data of dividing the diagnosis inrush condition of the ECU by whether the air compressor and the air tank are mounted due to a difference in brake type of the same vehicle are unified to filter 'injector injection error misdiagnosis' according to the data misinput as a diagnosis code in a field.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1A:
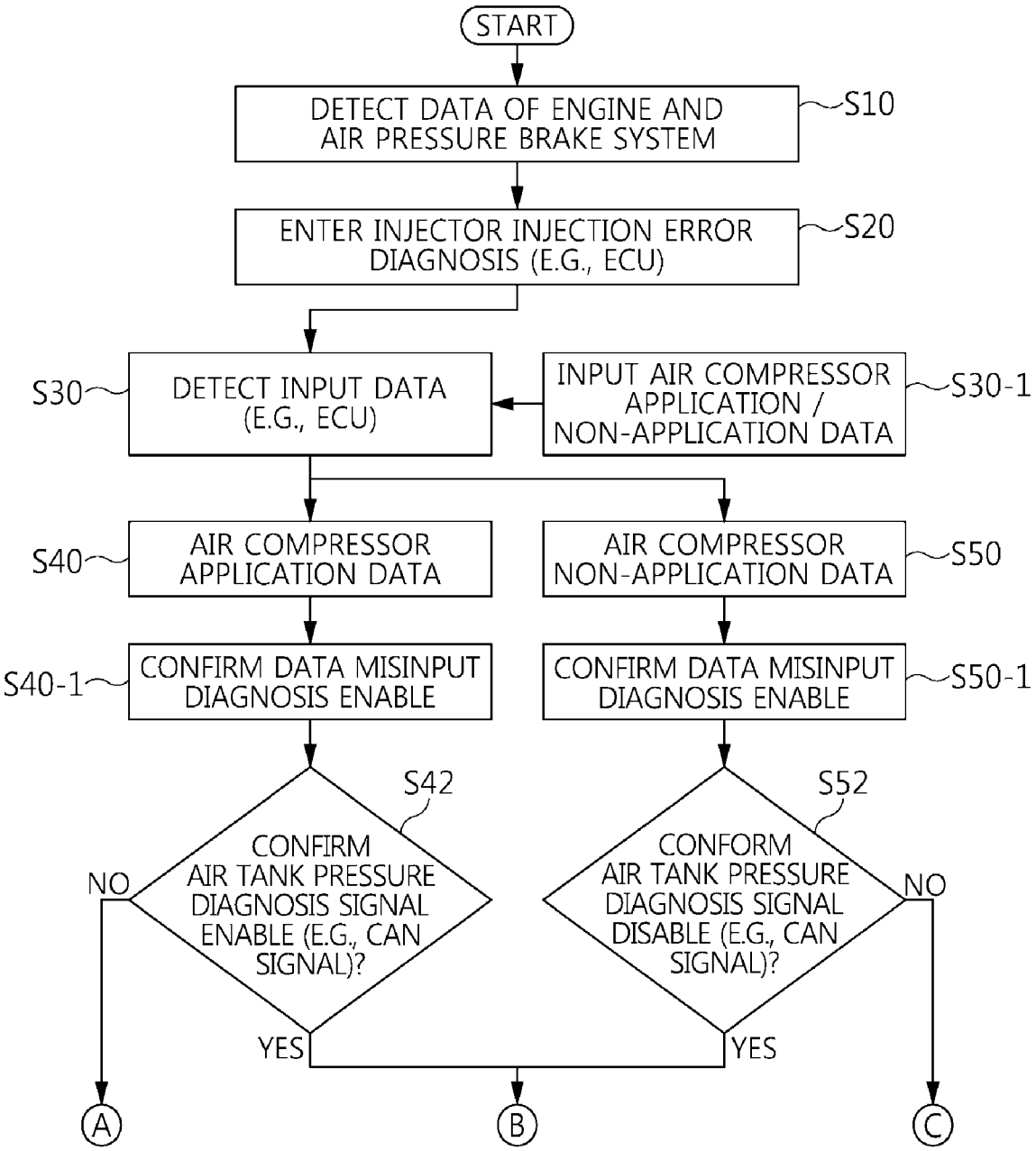
FIG. 1A and FIG. 1B are a method for injector injection error diagnosis using a diagnostic inrush condition according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, embodiments of the present invention will be described in detail with reference to the accompanying drawings and implemented in various modifications by those skilled in the art as examples, and the present invention is not limited to the exemplary embodiments described herein.

Figure 1B:
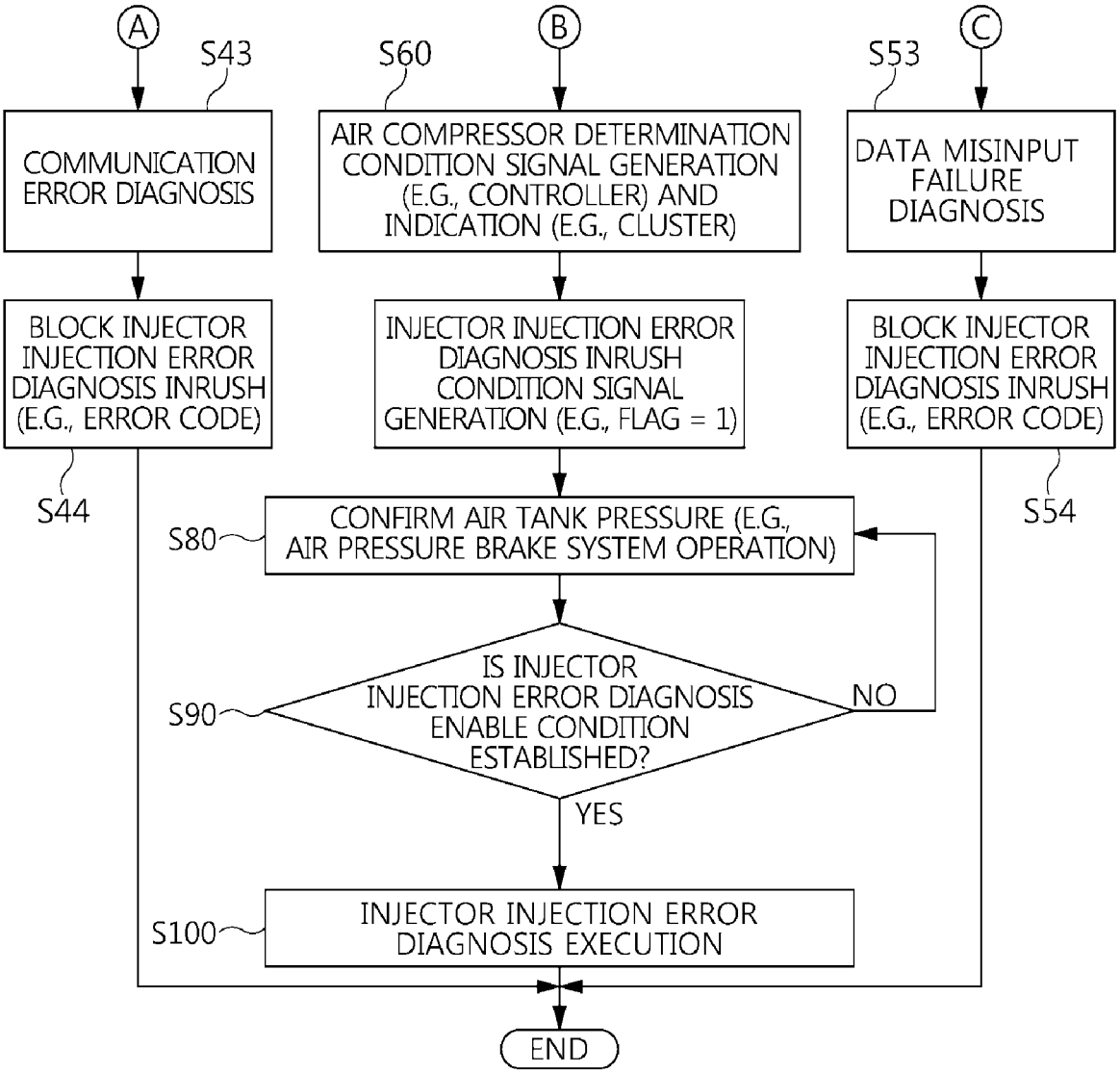

Referring to FIG. 1A and FIG. 1B, a method for injector injection error diagnosis using a diagnostic inrush condition is performed by an injector injection error diagnosis entry control (S20) according to an operation detection of an engine system and an air pressure brake system, a diagnostic inrush condition control (S30 to S90) of determining an injector injection error diagnosis entry condition due to a change in air tank pressure of an air tank 23 while an air compressor application condition and an air compressor non-application condition are divided, and an injector injection error diagnosis execution control (S100) according to satisfaction of the injector injection error diagnosis entry condition.

In the diagnostic inrush condition control (S30 to S90), a pressure sensor of an air tank (e.g., air cylinder) connected to the air compressor is used instead of not additionally mounting a separate pressure sensor in the air compressor to prevent misdiagnosis of an injector injection error and an injector injection error diagnosis condition is set to a condition in which the pressure of the air tank is stabilized as a predetermined level or more, reducing cost without adding the separate sensor to the air compressor.

As a result, the method for injector injection error diagnosis using the diagnostic inrush condition prevent misdiagnosis of the injector injection error when data of a field is incorrectly input as a 'data misinput diagnostic code' so as not to require construction of two kinds of data of a controller (e.g., an electronic control unit or ECU driver) so that the air compressor and the air tank are mounted/not mounted according to a brake type in the same vehicle.

Figure 2:
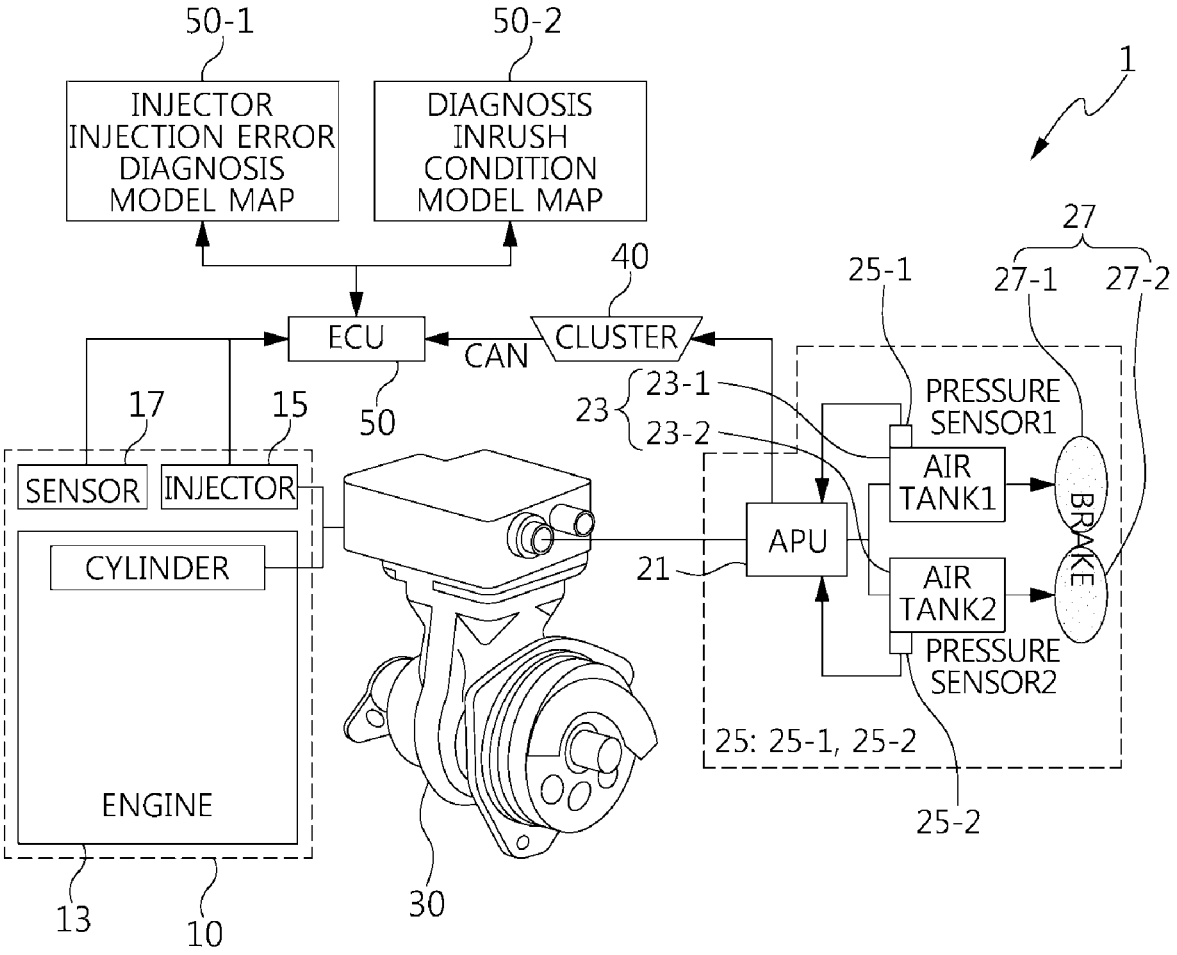
FIG. 2 is a schematic diagram of a system for injector injection error diagnosis in which air tank pressure is applied as a diagnostic inrush condition in injector injection error diagnosis according to an exemplary embodiment of the present invention.

Referring to FIG. 2, a system 1 for injector injection error diagnosis includes an engine system 10, an air pressure brake system 20, an air compressor 30, a cluster 40, and a controller 50.

For example, the engine system 10 includes an engine 13, an injector 15, and an engine sensor 17.

The engine 13 is connected to the air compressor 30 to transmit power to the air compressor 30 as an internal combustion engine. The injector 15 injects fuel to a an air-fuel mixture cylinder (i.e., cylinder) of the engine 13 by the control of the controller 50. The engine sensor 17 includes a coolant temperature/oil temperature sensor, a rotation speed sensor, a cam/crankshaft sensor, and the like to detect engine operation information related to the engine 13 transmitted to the controller 50. Therefore, the engine sensor 17 of the engine system 10 and a signal line detect engine operation information such as a coolant temperature, an oil temperature, an engine rotation speed, a camshaft location, a crankshaft location, and the like.

For example, the air pressure brake system includes an air processing unit (APU) 21, an air tank 23, an air tank pressure sensor 25, and a brake 27 as device components, and an air pressure line for a compressed air flow and a signal line for transmitting a sensor detection value as line components, and may further include a separator cooler which is not illustrated as the device component, but is configured as an oil separator for separating moisture and oil in hot and humid compressed air.

The APU 21 is configured as an air dryer for dehumidifying the compressed air, which is disposed in an air pressure line connecting the air tank 23 and the air compressor 30 and transmits brake operation information including the detection value of the air tank pressure sensor 25 to the cluster 40 connected to the signal line.

The APU 21 may apply an electronic air pressing unit (EAPU). The air tank 23 is divided into a first air tank 23-1 (or a front air tank) which is connected to the APU 21 by the air pressure line to fill the compressed air emitted from the APU 21 and provide air pressure to front wheels, and a second air tank 23-2 (or a rear air tank) that provides the air pressure to rear wheels.

The air tank pressure sensor 25 is divided into a first air tank pressure sensor 25-1 disposed in the first air tank 23-1 and a second air tank pressure sensor 25-2 disposed in the second air tank 23-2 and transmits air tank pressures of the first and second air tanks 23-1 and 23-2 detected by the first and second air tank pressure sensors 25-1 and 25-2 to the APU 21 connected to the signal line. The brake 27 is divided into a first brake 27-1 (or a front brake) for braking the front wheels and a second brake 27-2 (or a rear brake) for braking the rear wheels.

For example, the air compressor 30 is operated by the engine 13 of the engine system 10 and transmits the compressed air to the APU 21 of the air pressure brake system connected to the air pressure line.

For example, the cluster 40 is mounted on a driver's seat dashboard, and is connected to the APU 21 by the signal line to indicate air tank pressure. The cluster 40 transmits the air tank pressure to the controller 50 via CAN communication.

For example, the controller 50 receives the air tank pressures of the first and second air tank pressure sensors 25-1 and 25-2 as the brake operation information related to the air pressure brake system via the CAN communication with the cluster 40 while receiving the engine operation information related to the engine system 10. To the present end, the controller 50 may be an electronic control unit (ECU) or an ECU driver.

The controller 50 includes an injector injection error diagnosis model map 50-1 and a diagnostic inrush condition model map 50-2. The injector injection error diagnosis model map 50-1 constructs data applied to the injector injection error diagnosis and the diagnostic inrush condition model map 50-2 constructs air compressor application data and air compressor non-application data for the diagnostic inrush condition to proceed to the injector injection error diagnosis.

The air compressor application data is constructed by applying an air tank pressure diagnosis signal enable, a CAN communication error diagnosis, an injector injection error diagnosis inrush blocking error code, and the like, and the air compressor non-application data is constructed by applying an air tank pressure diagnosis signal enable, a data misinput fault diagnosis, an injector injection error diagnosis inrush blocking error code, and the like.

Figure 3:
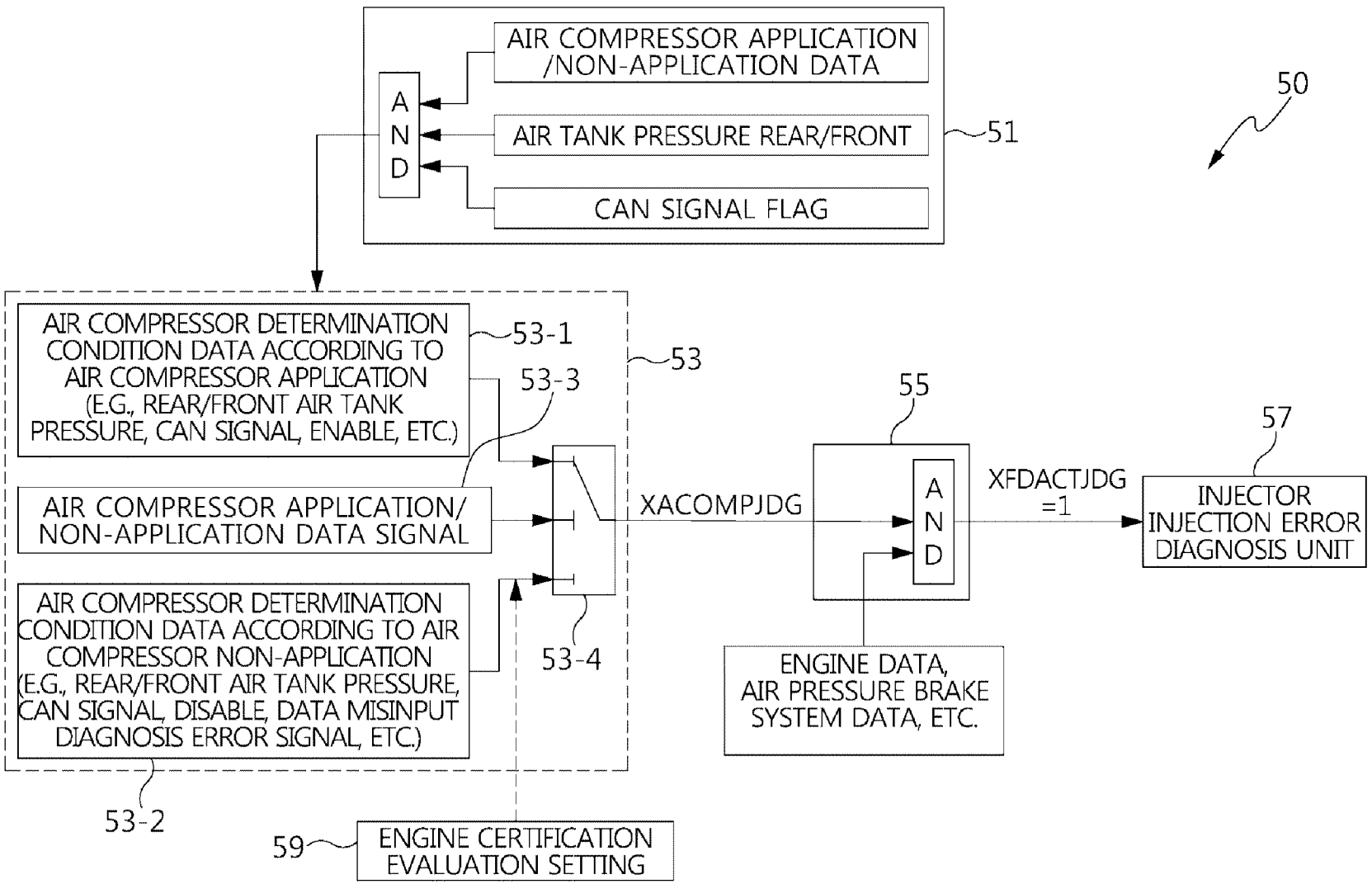
FIG. 3 is a controller block diagram of the system for injector injection error diagnosis according to an exemplary embodiment of the present invention.

As illustrated in FIG. 3, the controller 50 includes a data unit 51, a determination condition unit 53, a diagnostic inrush condition unit 55, an injector injection error diagnosis unit 57, and an engine certification evaluation unit 59, and the determination condition unit 53 includes an air compressor application processor 53-1, an air compressor non-application processor 53-2, an air compressor data 53-3, and an output unit 53-4. In the instant case, each function and operation of the data unit 51 and the determination condition unit 53, the diagnostic inrush condition unit 55 and the injector injection error diagnosis unit 57 will be described below in detail. On the other hand, the engine certification evaluation unit 59 is used as an input means for converting the output of the output unit 53-4 into an engine certification evaluation signal instead of the air compressor determination condition signal. Therefore, the engine certification evaluation unit 59 is a general means, and thus detailed description of the exemplary embodiment of the present invention will be omitted.

Hereinafter, the method for injector injection error diagnosis using the diagnostic inrush condition will be described in detail with reference to FIGS. 2 to 6. In the instant case, the control subject is the controller 50, and the controlled object is a component of the engine system 1 and a component of the air pressure brake system.

The controller 50 performs an injector injection error diagnosis entry control step of S20 following the data detection step of the engine system and the air pressure brake system of S10.

Referring to FIG. 2, the controller 50 confirms an operation state of the engine 13 as engine operation information obtained by the injector 15 and the engine sensor 17 of the engine system 10 and simultaneously confirms the air tank operation information including the air tank pressure of the air pressure brake system via the CAN communication with the cluster 40. Therefore, the controller 50 activates injector injection error diagnosis logic in accordance with the operation of the engine system 10.

Next, the controller 50 performs the input data detection step of S30 using the air compressor application/non-application input data of S30-1 with respect to the diagnostic inrush condition control (S30 to S90) divided into the air compressor application/non-application and divides the diagnostic inrush condition into an air compressor application data entry step of S40 and an air compressor non-application data entry step of S50.

Referring to FIG. 3, the controller 50 confirms the air compressor application data and the air compressor non-application data, the air tank pressure, and a CAN signal flag as input information through the data unit 51. Therefore, the controller 50 detects the air compressor application data and the air compressor non-application data of the data unit 51, performs the air compressor application data entry step (S40) in the case of detecting the air compressor application data, and performs the air compressor non-application data entry step (S50) in the case of detecting the air compressor non-application data.

In the case of the air compressor application data entry step (S40), the controller 50 performs the procedure by a data misinput diagnosis enable confirming step of S41, an air tank pressure diagnostic signal enable confirming step of S42 (e.g., a CAN signal), a communication error diagnosis step of S43, and an injector injection error inrush diagnosis blocking step (e.g., an error code) of S44.

Referring to FIG. 3, the controller 50 performs of steps S41 to S44 of the air compressor application data entry step (S40) using the air compressor application processor 53-1, the air compressor data 53-3, and the output unit 53-4, which are components of the determination condition unit 53.

For example, the data misinput diagnosis enable confirming step (S41) is performed by detection of the controller 50 with respect to an air compressor application data signal which is transmitted to the air compressor application processor 53-1 from the data unit 51.

For example, the air tank pressure diagnostic signal enable confirming step (e.g., a CAN signal) (S42) is performed by detection of the controller 50 with respect to the CAN signal flag which is transmitted to the air compressor application processor 53-1 from the data unit 51. Therefore, the controller 50 generates an error code according to the injector injection error inrush diagnosis blocking step (S44) after the communication error diagnosis step (S43) of the CAN when the CAN signal flag is not detected to stop the procedure of the injector injection error diagnosis entry step (S20) while indicating the generated error code by the cluster 40. On the other hand, when the CAN signal flag is detected, the controller 50 enters an air compressor determination condition signal generation (e.g., the controller 50) and indication (e.g., the cluster 40) step of S60.

In the case of the air compressor non-application data entry step (S50), the controller 50 performs the procedure by a data misinput diagnosis enable confirming step of S51, an air tank pressure diagnostic signal disable confirming step of S52 (e.g., a CAN signal), a data misinput failure diagnosis step of S53, and an injector injection error inrush diagnosis blocking step (e.g., an error code) of S54.

Referring to FIG. 3, the controller 50 performs of steps S51 to S54 of the air compressor non-application data entry step (S50) using the air compressor non-application processor 53-2, the air compressor data 53-3, and the output unit 53-4, which are components of the determination condition unit 53.

For example, the data misinput diagnosis enable confirming step (S51) is performed by detection of the controller 50 with respect to an air compressor non-application data signal which is transmitted to the air compressor non-application processor 53-2 from the data unit 51.

For example, the air tank pressure diagnostic signal disable confirming step (e.g., the CAN signal) (S52) is performed by detection of the controller 50 with respect to the CAN signal flag which is transmitted to the air compressor non-application processor 53-2 from the data unit 51. Therefore, the controller 50 generates an error code according to the injector injection error inrush diagnosis blocking step (S54) after the data misinput failure diagnosis step (S43) of the CAN when the CAN signal flag is detected to stop the procedure of the injector injection error diagnosis entry step (S20) while indicating the generated error code by the cluster 40. On the other hand, when the CAN signal flag is not detected, the controller 50 enters an air compressor determination condition signal generation (e.g., the controller 50) and indication (e.g., the cluster 40) step of S60.

Subsequently, the controller 50 performs sequentially an injector injection error diagnosis inrush conduction signal generation (e.g., diagnosis inrush flag=1) step of S70, an air tank pressure confirming (e.g., an air pressure brake system operation) step of S80, and an injector injection error diagnosis enable conduction establishment determining step after the air compressor determination condition signal generation and indication step of S60 with respect to the diagnostic inrush condition control (S30 to S90) and then converts the process into the injector injection error diagnosis execution step of S100.

The implementation of the air compressor determination condition signal generation and indication step (S60) is as illustrated in FIG. 3. As illustrated in FIG. 3, the controller 50 performs the procedure of the air compressor determination condition signal generation and indication step (S60) by the air compressor application data entry step (S40) by applying the air compressor application processor 53-1, the air compressor data 53-3, and the output unit 53-4, and distinguishes the air compressor determination condition signal generation and indication step (S60) by the air compressor non-application data entry step (S50) by applying the air compressor non-application processor 53-2, the air compressor data 53-3, and the output unit 53-4.

For example, the air compressor application processor 53-1 sets two types of information related to air tank pressure (that is, REAR/FRONT air tank pressure detection values of first and second air tank pressure sensors 25-1 and 25-2) and a CAN signal enable as air compressor determination condition data according to air compressor application and generates one air compressor application output signal from the two types of information. In the instant case, the air compressor application output signal may be generated as a common satisfaction condition (that is, an AND condition) of two signals.

Therefore, the output unit 53-4 receives an air compressor application output signal of the air compressor application processor 53-1 and an air compressor application data output signal of the air compressor data 53-3 while there is no signal input of the air compressor non-application processor 53-2.

As a result, an air compressor determination condition signal XACOMPJDG transmitted from the output unit 53-4 is obtained as a result of the air compressor determination condition signal generation and indication step (S60) by the air compressor application data entry step (S40).

For example, the air compressor non-application processor 53-2 sets three types of information related to air tank pressure (that is, REAR/FRONT air tank pressure detection values of first and second air tank pressure sensors 25-1 and 25-2), a CAN signal disable, and a data misinput diagnosis error signal as air compressor determination condition data according to air compressor non-application and generates one air compressor non-application output signal from the three types of information. In the instant case, the air compressor non-application output signal may be generated as a common satisfaction condition (that is, an AND condition) of the three signals.

Therefore, the output unit 53-4 receives an air compressor application output signal of the air compressor non-application processor 53-2 and an air compressor non-application data output signal of the air compressor data 53-3 while there is no signal input of the air compressor application processor 53-1. As a result, an air compressor determination condition signal XACOMPJDG transmitted from the output unit 53-4 is obtained as a result of the air compressor determination condition signal generation and indication step (S60) by the air compressor non-application data entry step (S50).

The implementation of the injector injection error diagnosis inrush condition signal generation step (S70) is as illustrated in FIG. 3. As illustrated in FIG. 3, the controller 50 generates a diagnostic inrush condition signal XFDACTJD as the air compressor determination condition signal information related to the output unit 53-4, the engine operation information related to the engine system 10, and the brake operation information related to the air pressure brake system through the diagnostic inrush condition unit 55. In the instant case, the diagnostic inrush condition signal XFDACTJD may be generated by setting the air compressor determination condition signal information, the engine operation information, and the brake operation information as a common satisfaction condition (i.e., an AND condition).

As a result, the injector injection error diagnosis inrush condition signal generation step (S70) outputs diagnosis inrush Flag=1 which means the diagnostic inrush condition signal XFDACTJD of the diagnostic inrush condition unit 55 to the injector injection error diagnosis unit 57.

The air tank pressure confirming (e.g., air pressure brake system operating) step (S80) and the injector injection error diagnosis enable condition establishment determining step (S90) mean air tank pressure confirmation control.

Figure 4:
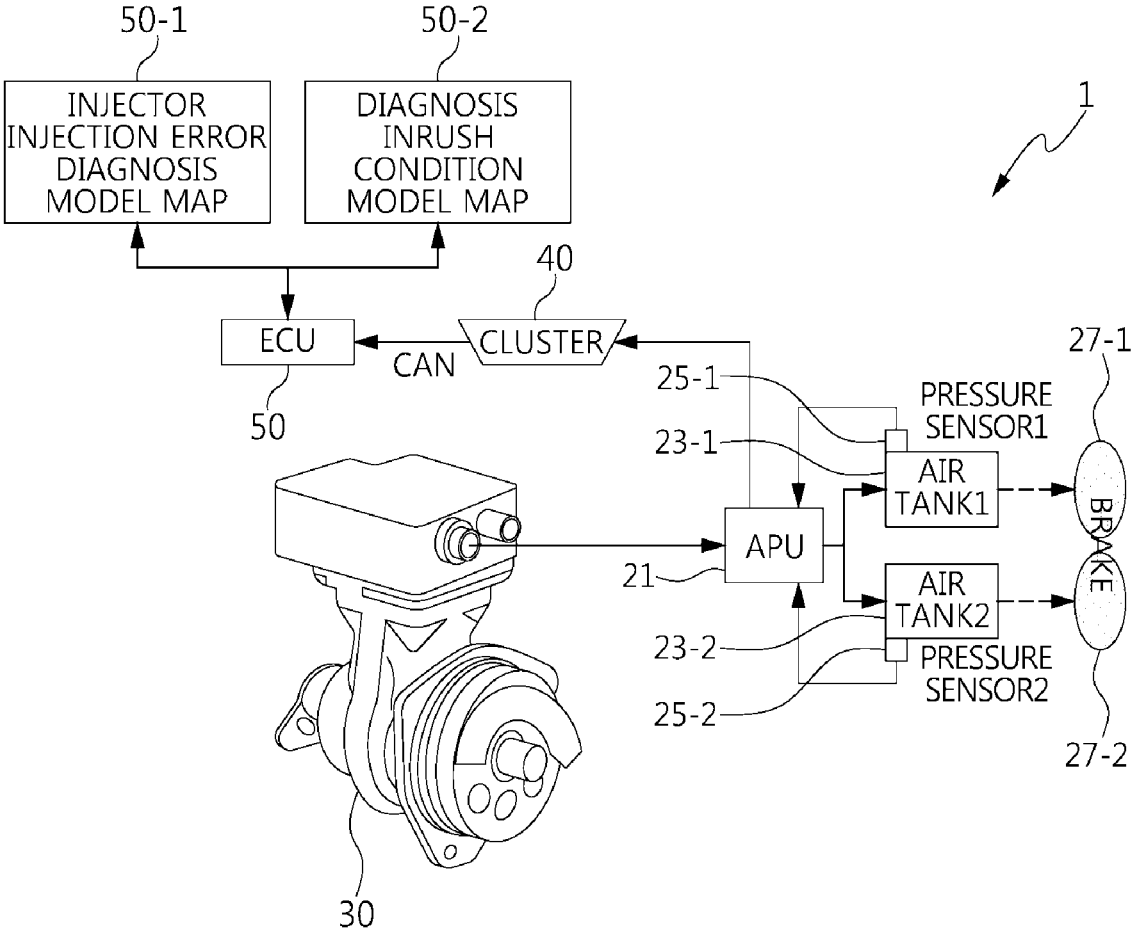
FIG. 4 is a diagram illustrating a state in which an air pressure brake system is operated by a brake operation according to an exemplary embodiment of the present invention.
Figure 5:
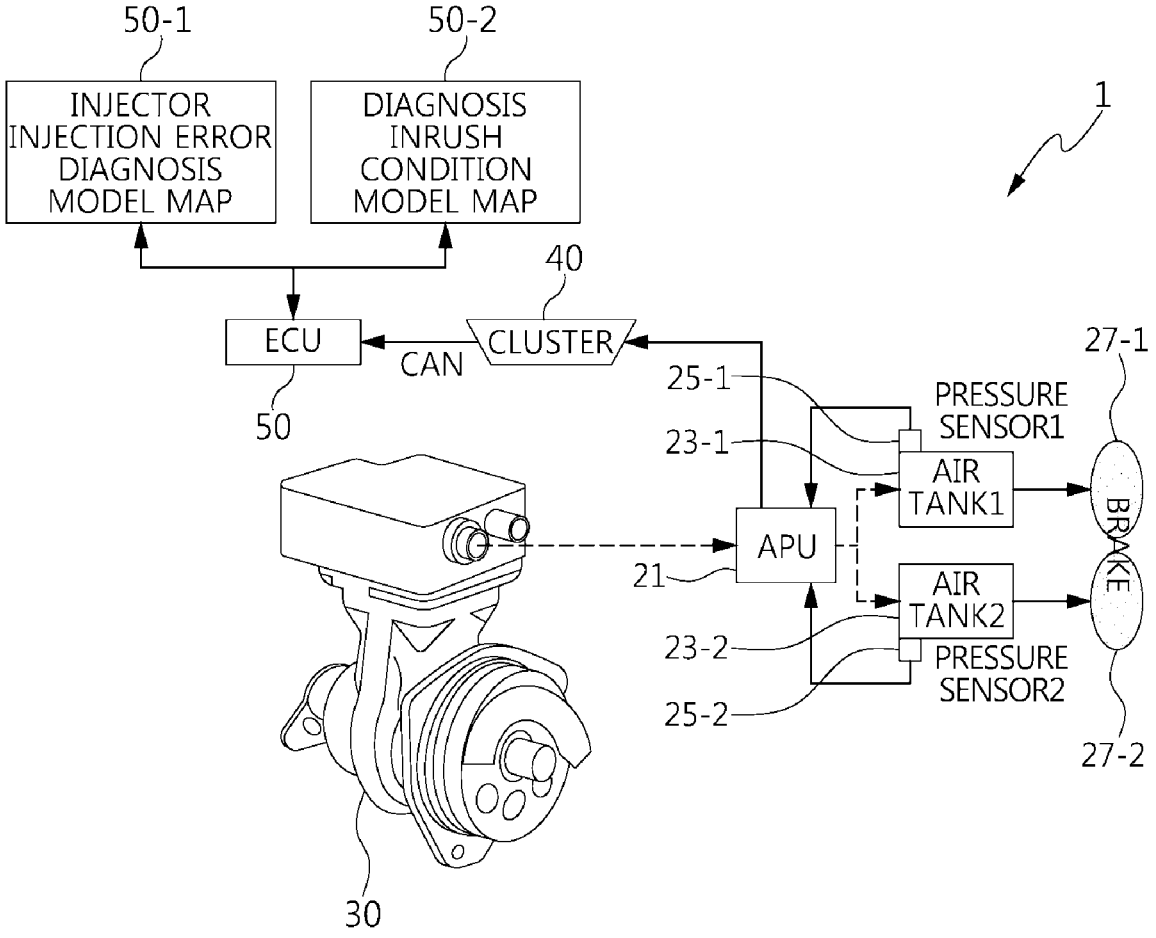
FIG. 5 is a diagram illustrating a state in which an engine load is generated by an air compressor load by the operation of the air pressure brake system according to an exemplary embodiment of the present invention.
Figure 6:
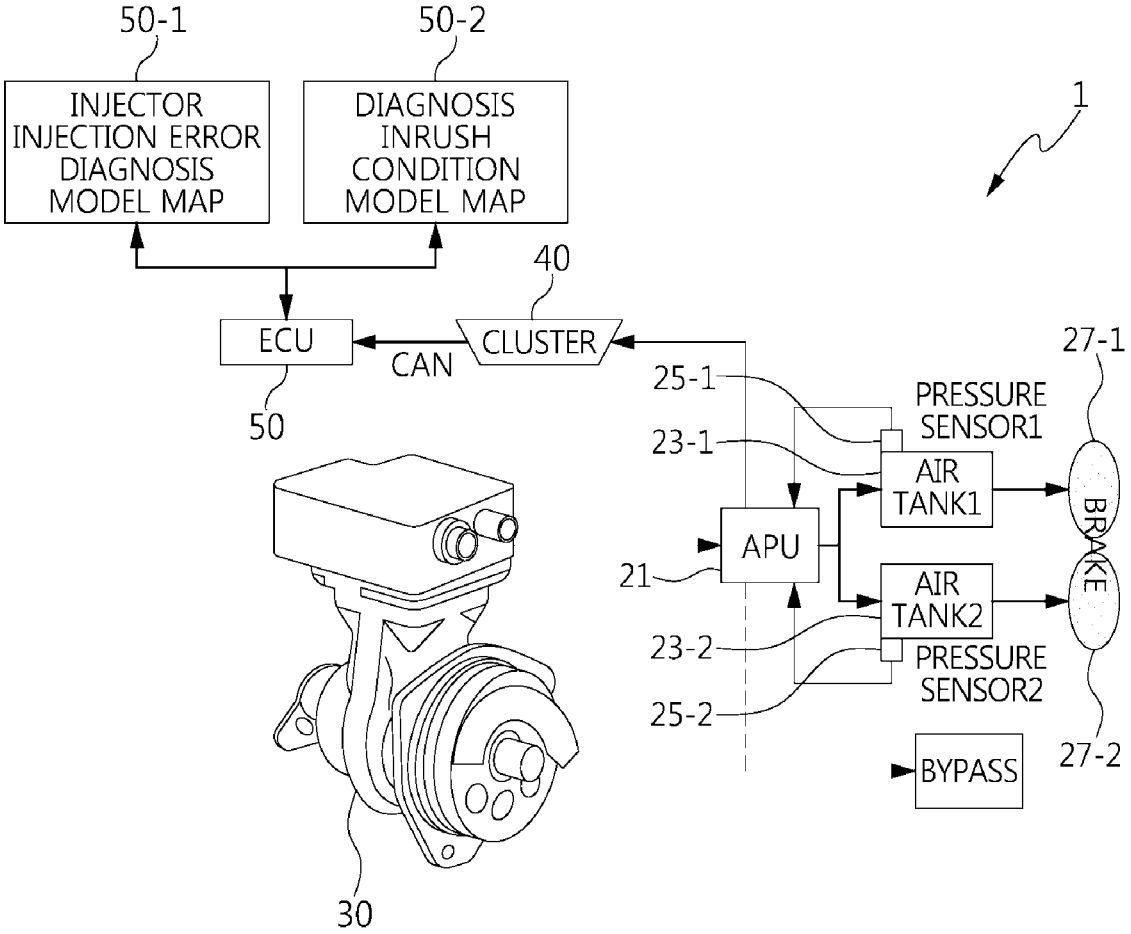
FIG. 6 is a diagram illustrating a state in which the diagnostic inrush condition for the injector injection error diagnosis is satisfied by releasing the load of the air compressor according to the stop of the brake and the air pressure brake system according to an exemplary embodiment of the present invention.

FIG. 4, FIG. 5 and FIG. 6 illustrate an operation state of the air pressure brake system for the air tank pressure confirmation control.

Referring to FIG. 4, when brake use is detected by the controller 50, the controller 50 transmits the compressed air of the air tank 23 to the brake 27 and the air pressure brake system consumes the pressure of the air tank 23. In the present process, the air tank 23 begins to decrease in pressure while the pressure is full, but the pressure of the air tank 23 is not reduced to be filled by the air compressor 30.

In the instant case, the air tank pressure is transmitted to the controller 50 through the APU 21 and the cluster 40 as the detection values of the first and second air tanks 23-1 and 23-2 detected by the first and second air tank pressure sensors 25-1 and 25-2. Therefore, the controller 50 continues the injector injection error diagnosis enable condition establishment determination step (S90) because the air tank pressure is reduced.

Referring to FIG. 5, when the controller 50 determines that the pressure is reduced to require the pressure filling of the first and second air tanks 23-1 and 23-2 through the first and second air tank pressure sensors 25-1 and 25-2, the controller 50 opens an air pressure line port of the APU 21 while the air compressor 30 is operating. As such, the air compressor 30 generates compressed air, the first and second air tanks 23-1 and 23-2 are filled with the compressed air passing through the APU 21, and the air tank pressures of the first and second air tanks 23-1 and 23-2 detected by the first and second air tank pressure sensors are transmitted to the controller 50 via the APU 21 and the cluster 40.

As a result, the operation of the air compressor 30 causes the air compressor load of the engine 13 to be generated. Therefore, the controller 50 continues the injector injection error diagnosis enable condition establishment determination step (S90) because the air compressor load is generated.

Referring to FIG. 6, when the controller 50 detects a brake release together with the full pressure of the air tank by the first and second air tank pressure sensors 25-1 and 25-2, the controller 50 opens a bypass port of the APU 21 while stopping the operation of the air compressor 30 to bypass the compressed air.

As a result, the stop of the air compressor 30 releases the air compressor load of the engine 13. Therefore, the controller 50 stops the injector injection error diagnosis enable condition establishment determination step (S90) because the air compressor load is released, and enters the injector injection error diagnosis execution step (S100).

Next, the controller 50 enters the injector injection error diagnosis execution step (S100), and the injector injection error diagnosis execution step (S100) is performed while the injector injection error diagnosis unit 57 of the controller 50 recognizes Flag=1 of the diagnosis inrush condition unit 55, and thus the injector injection error diagnosis execution procedure is performed the same as the existing injector injection error diagnosis execution logic.

In the instant case, the existing injector injection error diagnosis execution logic is a method of determining the angular velocity variation amount for each cylinder or the injection correction amount for each cylinder of the engine 13 using the injector 15.

As described above, the method for injector injection error diagnosis using the diagnostic inrush condition applied to the system 1 for injector injection error diagnosis according to the embodiment is performed by the diagnostic inrush condition control (S30 to S90) of determining the satisfaction of the injector injection error diagnosis entry condition due to a change in air tank pressure of an air tank 23 while the air compressor application condition and the air compressor non-application condition are divided, between the injector injection error diagnosis entry control (S20) according to the operation detection of the engine system 10 and the air pressure brake system and the injector injection error diagnosis execution control (S100), reducing the cost by use of the air tank pressure sensor while preventing the misdiagnosis and eliminating an effect on the misdiagnosis of the misinput data due to logic unification regardless of the type of brake requiring the air compressor application.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method for injector injection error diagnosis, the method comprising:

a diagnostic inrush condition control of establishing an injector injection error diagnosis entry condition as air tank pressure of an air tank applied to an air pressure brake system according to presence or absence of an air compressor when injector injection error diagnosis entry of a controller for an injector performing fuel injection to an engine of an engine system is performed, wherein the diagnostic inrush condition control is performed by:

a diagnostic inrush condition dividing step of determining due to change in the air tank pressure of the air tank;

a step of dividing air compressor application data and air compressor non-application data according to the presence or the absence of the air compressor;

a step of generating an air compressor determination condition signal by one of the air compressor application data and the air compressor non-application data;

a step of generating an injector injection error diagnosis inrush condition signal by detecting the air compressor determination condition signal, engine operation information related to the engine system, and brake operation information related to the air pressure brake system; and a step of establishing an injector injection error diagnosis enable condition by a change of the air tank pressure.

2. The method for injector injection error diagnosis of claim 1, wherein in the air compressor application data, the air compressor determination condition signal is generated by confirming an air tank pressure diagnosis signal enable in a data misinput diagnosis enable state.

3. The method for injector injection error diagnosis of claim 2, wherein when the air tank pressure diagnosis signal enable is not confirmed, the injector injection error inrush diagnosis is stopped.

4. The method for injector injection error diagnosis of claim 3, wherein the stop of the injector injection error inrush diagnosis is indicated on a cluster as an error code.

5. The method for injector injection error diagnosis of claim 3, wherein communication error diagnosis for non-confirmation of the air tank pressure diagnosis signal enable before the stop of the injector injection error inrush diagnosis is performed.

6. The method for injector injection error diagnosis of claim 1, wherein in the air compressor non-application data, the air compressor determination condition signal is generated by confirming an air tank pressure diagnosis signal disable in the data misinput diagnosis enable state.

7. The method for injector injection error diagnosis of claim 6, wherein when the air tank pressure diagnosis signal disable is not confirmed, the injector injection error inrush diagnosis is stopped.

8. The method for injector injection error diagnosis of claim 7, wherein the stop of the injector injection error inrush diagnosis is indicated on a cluster as an error code.

9. The method for injector injection error diagnosis of claim 7, wherein data misinput diagnosis for non-confirmation of the air tank pressure diagnosis signal disable before the stop of the injector injection error inrush diagnosis is performed.

10. The method for injector injection error diagnosis of claim 1, wherein the air compressor determination condition signal is indicated on a cluster and transmitted to the controller.

11. The method for injector injection error diagnosis of claim 1, wherein the injector injection error diagnosis inrush condition signal is output to a flag.

12. The method for injector injection error diagnosis of claim 1, wherein the change of the air tank pressure is generated by an operation of the air compressor acting as a load of the engine.

13. The method for injector injection error diagnosis of claim 12, wherein the change of the air tank pressure is a state in which the air tank returns to a predetermined pressure after a pressure reduction.

14. The method for injector injection error diagnosis of claim 1, wherein after the diagnostic inrush condition control, an injector injection error diagnosis execution control is performed and the injector injection error diagnosis execution control is to determine an angular velocity variation amount for each cylinder or an injection correction amount for each cylinder of the engine using the injector.

15. A system for injector injection error diagnosis, the system comprising:

a controller which performs a diagnostic inrush condition control by satisfying air tank pressure of an air tank as an injector injection error diagnosis entry condition while presence or absence of application of an air compressor is divided between injector injection error diagnosis entry and injector injection error diagnosis execution according to detection of operations of an engine system and an air pressure brake system.

16. The system for injector injection error diagnosis of claim 15, wherein the controller detects the air tank pressure of the air pressure brake system in association with a cluster that forms a driver's seat.

17. The system for injector injection error diagnosis of claim 15, wherein the air tank pressure is detected by an air tank pressure sensor mounted in the air tank.

18. The system for injector injection error diagnosis of claim 16, wherein communication between the controller and the cluster is performed by CAN.

* * * * *